United States Patent [19]

Deem

[11] Patent Number: 4,875,793

[45] Date of Patent: Oct. 24, 1989

[54] NOTEBOOK BINDER/LABEL HOLDER

[76] Inventor: William C. Deem, 15 Highview, P.O. Box 397, Jacksonville, Ill. 62651

[21] Appl. No.: 56,243

[22] Filed: Jun. 1, 1987

[51] Int. Cl.[4] ..... B42F 3/00; B42F 13/40; B42D 3/18

[52] U.S. Cl. ..... 402/3; 402/4; 281/51

[58] Field of Search ..... 402/46, 54, 59, 74, 402/2, 3, 4; 281/1; 40/2 R, 10 R, 16, 4

[56] References Cited

U.S. PATENT DOCUMENTS

| | | | |
|---|---|---|---|
| 1,211,672 | 1/1917 | Chin | 281/1 |
| 2,659,512 | 11/1953 | Czerniawski | 402/4 |
| 2,764,161 | 9/1956 | Sobesky | 402/3 |
| 3,209,757 | 10/1965 | Littler | 402/3 |
| 3,211,156 | 10/1965 | Dennis | 402/3 |

FOREIGN PATENT DOCUMENTS

| | | | |
|---|---|---|---|
| 971049 | 1/1951 | France | 402/3 |

*Primary Examiner*—Frank T. Yost
*Assistant Examiner*—Paul M. Heyrana
*Attorney, Agent, or Firm*—Olson & Hierl

[57] ABSTRACT

A notebook binder supporting device or label holder device for a paperboard note book having removable sheets retained by binding strips which pass therethrough. Said device is formed from heavy sheet material and has a substantially flat label portion adapted to bear against the rear edges of the sheets of the notebook, said device also having an integral substantially flat flange portion extending forwardly from the label portion in a plane disposed at an angle 90 degrees from the plane of the label portion. Said device is secured by binding strips passing through holes therethrough, the paper and cover portions. Said device functions as a binder to hold paper and as a label holder as well as supporting means for the entire paperboard notebook binder.

3 Claims, 1 Drawing Sheet

NOTEBOOK BINDER/LABEL HOLDER

BACKGROUND AND SUMMARY OF THE INVENTION

This invention relates to a notebook binder or rigid supporting device to be used on paperboard notebooks, and more particularly, to a label holder for said books.

Conventional paperboard binders are easy to use and are structured so that sheets may be removed or added conveniently. The sheets are secured to the two paperboard covers by one metal binding strip that passes through two holes in the paperboard covers and two holes in the paper with the ends being bent at 90 degree angles to secure the sheets. More specifically, the two ends of the metal binding strip when passed through the holes of the covers and paper are at opposed ends of the length of the paper near the rear edge or left margin of the paper. The metal binding strips also pass through a fastening means permitting the ends of the binding strips to be folded toward each other. These structures have no rigid support other than the paper board cover. Further, the books lack a labelling area on the back edge or "bending" area of the notebook.

Prior art devices have attempted to label binders but not in the manner of the present invention. U.S. Pat. No. 1,122,102 discloses a title plate which is angular in shape. A single piece of metal is bent longitudinally from a solid vertical front member adapted on its exposed face for labelling. U.S. Pat. Nos. 1,211,672 and 1,218,733 disclose "T" shaped binder backs that may be suitable for labelling. U.S. Pat. No. 2,764,161 discloses a label holder for a ledger book. Said label holder is formed of plastic and does not run the entire length of the sheets in the ledger book. U.S. Pat. No. 2,301,450 discloses a loose leaf binder with angular shaped back support. None of the patents describe a rigid support and label holder for paperboard notebooks having sheets retained by binding strips.

The object of the present invention is to provide a structurally simple support device for paperboard notebooks or binders.

Another object of the present invention is to provide a label holder for paperboard notebooks or binders. In accordance with the present invention, a notebook binder or label holder device for a paperboard covered book having sheets retained by binding strips is disclosed. Said binder or label holding device is formed of rigid sheet material, such as metal, and has a substantially flat label portion adapted to bear against the rear edges of the sheets of the notebook. Said binder or label holder device also has an integral substantially flat flange portion extending forwardly from the label portion at a plane disposed at an angle 90 degrees from the plane of the label portion and adapted to be disposed in front of the first page, or after the last page, in said book.

DESCRIPTION OF THE DRAWINGS

Specific embodiments of the present invention will now be described by way of example, and not by way of limitation, with reference to the accompanying drawings in which:

With reference now to the accompanying drawings, the label holding device illustrated partially in FIG. 1 and completely in FIG. 2, consists, in detail of sheet material formed into angled bar with two flanges. The angled bar may be constructed from many rigid material such as rigid plastic or metal including steel, aluminum, etc., wood or paperboard. This list is not intended to be limiting for any rigid sheet material will function as the label holding device. Flange 2 fits securely abutting the back edges of paper 3 which is fastened within paperboard notebook 4 comprising covers 5A and 5B. Forward extending flange 6 extends away from label holder 2. Forward extending flange 6 is disposed 90 degrees from label holder 2 as more readily illustrated in FIG. 5. As illustrated in FIG. 3, slots 7 in forward extending flange 6 provide an open passageway for bendable metal binding strips 8 that run the length of cover 5B defined by opening 8 in folded portion 10 of cover 5B. Metal binding strip 8 passes through paper 3, forward extending flange 6 through openings 12 of folded cover 11. Track or fastening means 13 securely fits on folded portion 12 to receive bendable metal binding strips 8 through slots 14. Once metal binding strips 8 are passed through slot 14 they may be bent at an angle of 90 degrees towards or away from one another to lie flat on track or fastening means 13. Cover 5A may then be closed.

Figure 1:
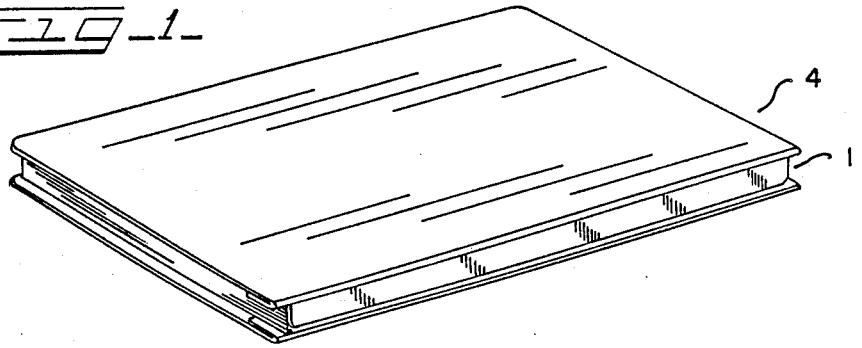
FIG. 1 is a perspective general view of a paperboard covered notebook or binder filled with sheets of paper with the binder or label holder device of the present invention included thereon.
Figure 2:
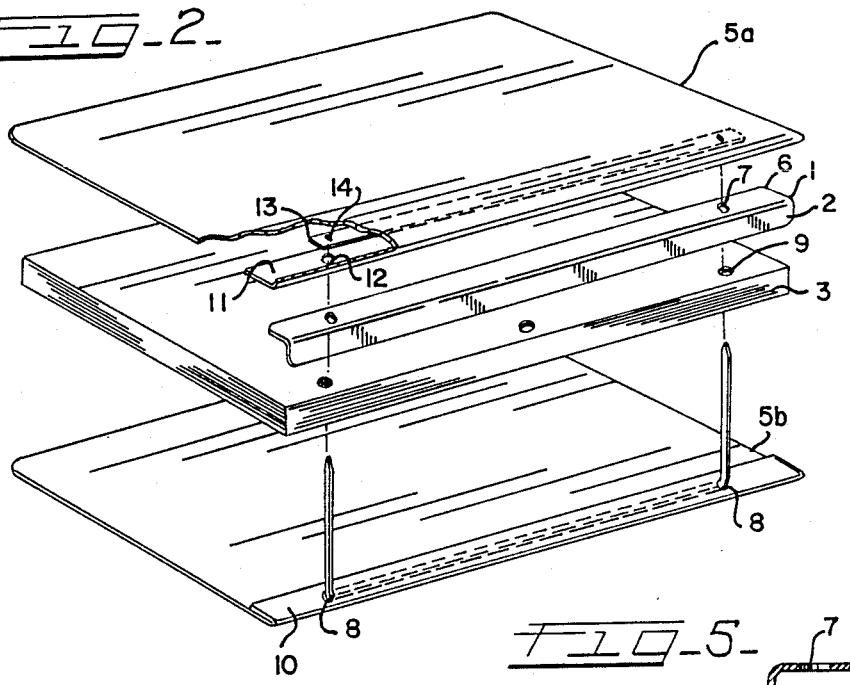
FIG. 2 is a spaced apart exploded view of the paperboard notebook showing the sheets of paper, binding strips, covers and the product of the present invention.
Figure 5:
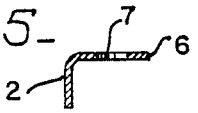
FIG. 5 is a view taken at lines 5—5 of FIG. 4 showing the end view of the notebook binder and label holder device emphasizing the 90 degree angle between the label holder and forward extending flange.

An optional embodiment provides for forward extending slots 7*a* to horizontally expand slots 7 in forward extending flange 6. Slots 7*a* will be utilized when the number of pages is low and the accumulated pages are narrower than the width of label holder 2. In this instance, metal binding strips 8 may be slid into slots 7*a* of flange 6 thereby extending label holder 2 over the edge of folded portion 10 of cover 5B. This position reduces the width of the label holder 2 that is in contact with paper 3, allowing metal binding strip 8 to securely engage fastening means 13 to hold a small number of pages in the paperboard binder.

This embodiment functions equally well if forward extending flange 6 is positioned after the last page in said binder, wherein label holder 2 is extended over the edge of folded portion 11 of cover 5*a*.

Label holder 2 may receive markings or labels to identify contents of the paperboard binder. Further, the label holder 1 being rigid and supportive, may serve as a supportive binder for the paperboard notebook. In this respect, paper holder 1 is referred to as a binder because of its rigid support and secure fit in paperboard binder 4 to add rigidity and strength to the bound materials or paper 3 as well as paperboard covers 5A and 5B.

Figure 3:
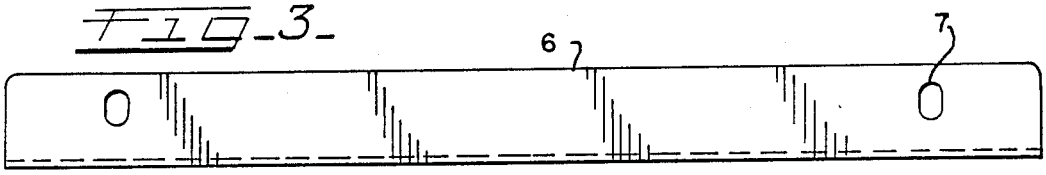
FIG. 3 is a top view of the substantially flat flange portion of the label holder device which extends forwardly from the label portion.

In FIG. 3, slots 7 and 7*a* are clearly shown in forward extending flange 6.

Figure 4:
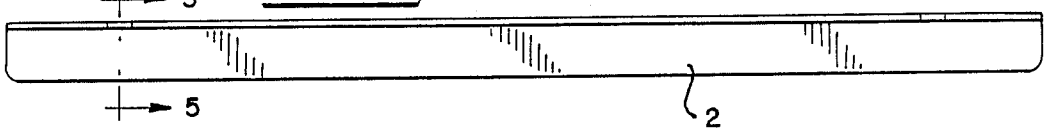
FIG. 4 is a front plan view of the notebook binder and label holder device of the present invention showing the label portion of the device which fits against substantially entire lengths of sheets of paper as well as the substantial flat flange portion which extends forwardly from the label portion in a plane disposed at an angle of 90 degrees in the plane of the label portion.

In FIG. 4, label holder 2 is shown.

Although I have described only one embodiment of my invention in detail, it will be understood that the description thereof is illustrative, rather than restrictive, as many details may be modified or changed without departing from the spirit of my invention. Accordingly, I do not desire to be restricted to the distinct construction described, except as limited by the appended claims.

I claim:

1. A label holder or rigid support device for paperboard binders having two covers and paper sheets retained by metal binding strips and fastening means said label device being formed of rigid sheet material and having a flat label portion to bear against substantially the entire length of the rear edges of said paper sheets, said label device also having an integral substantially flat securing flange extending rearwardly from the label portion in a plane disposed at an angle of ninety degrees from the plane of the label portion and engaging on the top sheets of the binder with the label portion pointed toward the back of the binder or on the bottom sheets of the binder with the flat securing flange pointed toward the front of the binder, said flange defining openings through which said metal binding strips pass for securing said label device to the sheets and said fastening means.

2. The label holder or rigid suppport device of claim 1 wherein the sheet material is selected from the group consisting of rigid plastic, metal, wood or paperboard.

3. The label holder of claim 1 wherein said flange contains forward extending slots from said openings for slidably engaging said metal binding strips to permit movement of said flange and said label portion connected thereto, thereby allowing said label portion to engage the edge of a cover of said paperboard binder.

* * * * *